US010466606B2

(12) United States Patent
Kojima

(10) Patent No.: US 10,466,606 B2
(45) Date of Patent: Nov. 5, 2019

(54) DEVELOPER, DEVELOPER CARTRIDGE, DEVELOPING DEVICE AND IMAGE FORMING APPARATUS

(71) Applicant: Oki Data Corporation, Tokyo (JP)

(72) Inventor: Takeshi Kojima, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 16/040,688

(22) Filed: Jul. 20, 2018

(65) Prior Publication Data

US 2019/0025722 A1 Jan. 24, 2019

(30) Foreign Application Priority Data

Jul. 24, 2017 (JP) ..... 2017-142664

(51) Int. Cl.
*G03G 9/097* (2006.01)
*G03G 9/08* (2006.01)
*G03G 9/087* (2006.01)

(52) U.S. Cl.
CPC ..... *G03G 9/0819* (2013.01); *G03G 9/0821* (2013.01); *G03G 9/0827* (2013.01); *G03G 9/08782* (2013.01); *G03G 9/09708* (2013.01); *G03G 9/09725* (2013.01); *G03G 9/09733* (2013.01); *G03G 9/09775* (2013.01)

(58) Field of Classification Search
None
See application file for complete search history.

(56) References Cited

U.S. PATENT DOCUMENTS 6,420,078 B1 * 7/2002 Ciccarelli ..... G03G 9/09708 430/108.3
7,862,970 B2 * 1/2011 Hawkins ..... G03G 9/0804 430/108.22
2015/0072279 A1 * 3/2015 Kuwabara ..... G03G 9/0806 430/105

FOREIGN PATENT DOCUMENTS

JP 2012242492 A 12/2012

* cited by examiner

*Primary Examiner* — Janis L Dote
(74) *Attorney, Agent, or Firm* — Panitch Schwarze Belisario & Nadel LLP

(57) ABSTRACT

A developer including a colored resin particle and an external additive added to a surface of the colored resin particle and having a diameter smaller than or equal to 200 nm is provided. The external additive includes a nitrogen-containing resin particle. In elemental analysis of the nitrogen-containing resin particle, a peak appearing in a range of 0.38-0.42 keV is expressed as an N-peak, and a peak appearing in a range of 0.48-0.52 keV is expressed as an O-peak. Maximum count numbers in the N-peak and the O-peak of the external additive on a surface of the colored resin particle are respectively expressed as N1 and O1. Maximum count numbers in the N-peak and the O-peak of the surface of the colored resin particle where no external additive is observed are respectively expressed as N2 and O2. The count numbers N1, O1, N2 and O2 satisfy $1.7\times(N2/O2)<(N1/O1)$.

9 Claims, 7 Drawing Sheets

DEVELOPER, DEVELOPER CARTRIDGE, DEVELOPING DEVICE AND IMAGE FORMING APPARATUS

CROSS-REFERENCE TO RELATED APPLICATION

This application claims priority to Japanese Patent Application No. 2017-142664, filed on Jul. 24, 2017, the disclosure of which is incorporated herein by reference in its entirety.

BACKGROUND OF THE INVENTION

The present invention relates to a developer used in an electrophotographic image forming apparatus such as a copier, a facsimile machine, a printer or the like, and also relates to a developer cartridge, a developing device and the image forming apparatus.

A general toner (developer) includes a colored resin particle and an external additive added to a surface of the colored resin particle. The external additive is formed of inorganic or organic substance, and is added in order to obtain a desired flowability and charging characteristics. The external additive contains, for example, a hydrophobic silica fine powder having a number-average primary particle diameter of 7-16 [nm], a colloidal silica fine powder having a number-average primary particle diameter of 65-100 [nm], and a nitrogen-containing resin particle having a number-average primary particle diameter of 200-300 [nm]. By using such a toner, a decrease in flowability of the toner during a continuous printing is suppressed, and deterioration of image quality is suppressed. See, for example, Japanese Patent Application Publication No. 2012-242492 (Page 32 and FIG. 1).

However, in the toner of the above described document, the nitrogen-containing resin particle may easily separate from the surface of the colored resin particle, and may cause ghost. When a large amount of the external additive is added to the toner in order to reduce a cohesion degree (i.e., to increase a flowability), the ghost is more likely to occur. Therefore, it is difficult to obtain a toner having a desired flowability (i.e., capable of suppressing image blurring) and capable of suppressing ghost.

SUMMARY OF THE INVENTION

An aspect of the present invention is intended to provide a developer capable of suppressing image blurring and ghost.

According to an aspect of the present invention, there is provided a developer including a colored resin particle, and an external additive added to a surface of the colored resin particle and having a diameter smaller than or equal to 200 [nm]. The external additive includes a nitrogen-containing resin particle. In elemental analysis of the nitrogen-containing resin particle, when a peak appearing in a range from 0.38 to 0.42 keV is expressed as an N-peak, a peak appearing in a range from 0.48 to 0.52 keV is expressed as an O-peak, a maximum count number in the N-peak and a maximum count number in the O-peak of the external additive on the surface of the colored resin particle are respectively expressed as N1 and O1, and a maximum count number in the N-peak and a maximum count number in the O-peak of the surface of the colored resin particle where no external additive is observed are respectively expressed as N2 and O2, the count numbers N1, O1, N2 and O2 satisfy $1.7\times(N2/O2)<(N1/O1)$. The developer has a cohesion degree in a range from 63.7 to 80.9.

With such a configuration, it is possible to suppress phenomena such as image blurring, a vertical streak, ghost or the like.

DETAILED DESCRIPTION OF THE PREFERRED EMBODIMENT

Figure 1:
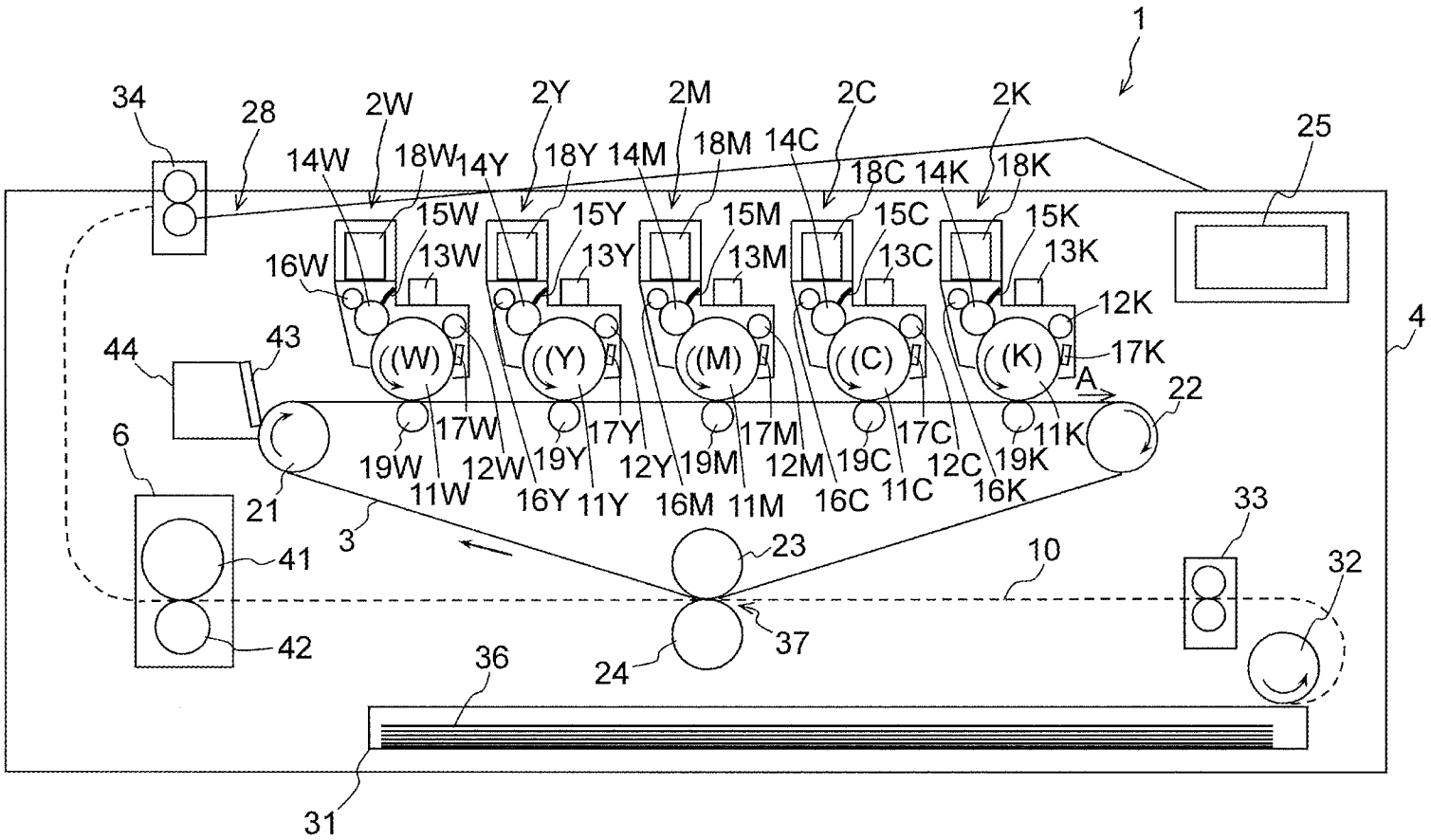
FIG. 1 is a schematic diagram showing a configuration of a printer as an image forming apparatus of the embodiment of the present invention.

FIG. 1 is a schematic diagram showing a basic configuration of a printer 1 as an image forming apparatus of the embodiment of the present invention.

The printer 1 is configured as, for example, an electrophotographic color printer. To be more specific, the printer 1 has a configuration using a non-magnetic single-component development system (to be more specific, a non-magnetic single-component contact development system). The printer 1 includes five independent image forming units 2W, 2Y, 2M, 2C and 2K corresponding to white (W), yellow (Y), magenta (M), cyan (C) and black (K) disposed in a housing 4. The image forming units 2W, 2Y, 2M, 2C and 2K are arranged in this order along a moving direction (indicated by an arrow A) of an intermediate transfer belt 3. The image forming units 2W, 2Y, 2M, 2C and 2K may be referred to as image forming units 2 when there is no need to distinguish them from each other.

The image forming unit 2W is configured to form a toner image of white (W). The image forming unit 2Y is configured to form a toner image of yellow (Y). The image forming unit 2M is configured to form a toner image of magenta (M). The image forming unit 2C is configured to form a toner image of cyan (C). The image forming unit 2K is configured to form a toner image of black (K).

The five image forming units 2 have the same configuration except for toners. Therefore, a configuration of the image forming unit 2W will be described herein.

The image forming unit 2W includes a photosensitive drum 11W as a latent image bearing body, an charging roller 12W as a charging member (or a latent image bearing body charging member) configured to uniformly charge a surface of the photosensitive drum 11W, and a developing roller 14W as a developer bearing body configured to cause a toner (not shown) of white to adhere to an electrostatic latent image formed on the surface of the photosensitive drum 11W and form a toner image of white (W) as a visible image. The image forming unit 2W further includes a supply roller 16W provided in contact with the developing roller 14W and configured to supply a toner to the developing roller 14W. The image forming unit 2W further includes a cleaning blade 17W as a resilient member configured to scrape off a fog-toner, a transfer-residual toner remaining on the surface of the photosensitive drum 11W, and a reversely transferred toner from the upstream image forming unit 2. The resilient member contacts the latent image bearing body at a position upstream of the charging member and downstream of the developer bearing body in a rotating direction of the latent image bearing body.

In this regard, a developing device corresponds to a part of the image forming unit 2 except for a toner cartridge 18. In a particular example, the toner cartridge 18 as a developer cartridge is detachably attached to the developing device. The toner cartridge 18 stores the toner of white.

The supply roller 16W is configured to supply the toner (supplied from the toner cartridge 18W) to the developing roller 14W. The developing blade 15W (i.e., a layer formation blade) is pressed against the developing roller 14W. By action of the developing blade 15W, the toner on the developing roller 14W supplied from the supply roller 16W is formed into a thin toner layer.

Similarly, the image forming units 2Y, 2M, 2C and 2K include photosensitive drums 11Y, 11M, 11C and 11K, charging rollers 12Y, 12M, 12C and 12K, developing rollers 14Y, 14M, 14C and 14K, developing blades 15Y, 15M, 15C, and 15K, supply rollers 16Y, 16M, 16C and 16K, cleaning blades 17Y, 17M, 17C and 17K, and toner cartridges 18Y, 18M, 18C and 18K. In this regard, the photosensitive drums 11Y, 11M, 11C and 11K may be referred to as photosensitive drums 11 when there is no need to distinguish them from each other. The charging rollers 12Y, 12M, 12C and 12K may be referred to as charging rollers 12 when there is no need to distinguish them from each other. The developing rollers 14Y, 14M, 14C and 14K may be referred to as developing rollers 14 when there is no need to distinguish them from each other. The developing blades 15Y, 15M, 15C and 15K may be referred to as developing blades 15 when there is no need to distinguish them from each other. The supply rollers 16Y, 16M, 16C and 16K may be referred to as supply rollers 16 when there is no need to distinguish them from each other. The cleaning blades 17Y, 17M, 17C and 17K may be referred to as cleaning blades 17 when there is no need to distinguish them from each other. The toner cartridges 18Y, 18M, 18C and 18K may be referred to as toner cartridges 18 when there is no need to distinguish them from each other.

LED heads 13W, 13Y, 13M, 13C and 13K are disposed above and facing the photosensitive drums 11W, 11Y, 11M, 11C and 11K of the image forming unit 2W, 2Y, 2M, 2C and 2K. The LED heads 13W, 13Y, 13M, 13C and 13K may be referred to as LED heads 13 when there is no need to distinguish them from each other. Each LED head 13 (i.e., an exposure device) includes a plurality of light emitting elements (for example, LEDs) arranged in a main scanning direction (i.e., a direction parallel to a rotation axis of the photosensitive drum 11). Each LED head 13 exposes a surface of the photosensitive drum 11 to form an electrostatic latent image based on image data of a corresponding color inputted from a host computer.

Primary transfer rollers 19W, 19Y, 19M, 19C and 19K are disposed below the photosensitive drum 11W, 11Y, 11M, 11C and 11K so that the primary transfer rollers 19W, 19Y, 19M, 19C and 19K respectively face the photosensitive drum 11W, 11Y, 11M, 11C and 11K via the intermediate transfer belt 3. The primary transfer rollers 19W, 19Y, 19M, 19C and 19K are referred to as primary transfer rollers 19 when there is no need to distinguish them from each other. Each pair of the primary transfer roller and the photosensitive drum 11 press the intermediate transfer belt 3 therebetween. The primary transfer roller 19 primarily transfers a toner image from the photosensitive drum 11 to the intermediate transfer belt 3.

In this regard, the developing roller 14 includes a metal shaft and a resilient body provided around the metal shaft. The resilient body is, for example, a semiconductive urethane rubber having a rubber hardness (Asker-C hardness) of 70 degrees. The supply roller 16 includes a metal shaft and a foam provided around the meal shaft. The foam is, for example, a silicone foam having a hardness (Asker-F hardness) of 50 degrees. The photosensitive drum 11 includes a conductive support body having a cylindrical shape, and a laminated body (i.e., a photosensitive layer) formed on a surface of the support body. The laminated body include a blocking layer, a charge generation layer and a charge transport layer which are laminated in this order on the support body. The charge transport layer is coated to a thickness of approximately 18 μm.

The intermediate transfer belt 3 has an endless shape, and is formed of a semiconductive plastic film having a high resistance. The intermediate transfer belt 3 is wound around a driving roller 21, a driven roller 22 and a secondary transfer opposing roller 23, and is applied with a predetermined tension. The driving roller 21 is driven to rotate by a belt motor, and causes the intermediate transfer belt 3 to move in the direction shown by the arrow A in FIG. 1. The driven roller 22 rotates following a movement of the intermediate transfer belt 3.

In this example, while the intermediate transfer belt 3 moves in the moving direction as shown by the arrow A, the intermediate transfer belt 3 moves horizontally in a region between the driving roller 21 and the driven roller 22. The five image forming units 2 are arranged in the above described order along a horizontal path of the intermediate transfer belt 3. When the intermediate transfer belt 3 moves in this horizontal path, the intermediate transfer belt 3 passes through between the photosensitive drum 11 of each image forming unit 2 and the primary transfer roller 19 facing the photosensitive drum 11.

The intermediate transfer belt 3 is pressed against the photosensitive drums 11 by the primary transfer rollers 19 facing the photosensitive drums 11. The intermediate transfer belt 3 contacts the photosensitive drums 11 to form primary transfer nip portions. The primary transfer rollers 19 are applied with predetermined primary transfer voltages (i.e., direct voltages) by a transfer voltage controller 66 (FIG. 2) described later. In the primary transfer nip portions, the primary transfer voltages cause the toner images on the photosensitive drums 11 to be primarily transferred to the intermediate transfer belt 3 in an overlapping manner.

The printer 1 has a sheet storage cassette 31 disposed below the image forming units 2 and the intermediate transfer belt 3 inside the housing 4. The sheet storage cassette 31 is configured to supply recording sheets 36 to a feeding path 10 shown by a dashed line in FIG. 1.

The sheet storage cassette 31 stores a stack of a plurality of recording sheets 36. A delivery roller 32 is configured to feed the recording sheet 36 from the sheet storage cassette 31 toward a pair of feeding rollers 33 along the feeding path 10. The feeding rollers 33 correct a skew (i.e., inclined feeding) of the recording sheet 36, and feed the recording sheet 36 toward a secondary transfer roller 24 disposed facing the secondary transfer opposing roller 23 via the intermediate transfer belt 3.

The secondary transfer roller 24 rotates following the movement of the intermediate transfer belt 3. The intermediate transfer belt 3 is pressed against the secondary transfer opposing roller 23 by the secondary transfer roller 24. The secondary transfer roller 24 and the intermediate transfer belt contact each other to form a secondary transfer nip portion 37. The secondary transfer roller 24 is applied with a predetermined secondary transfer voltage (i.e., a direct voltage) by the transfer voltage controller 66 (FIG. 2) described later. In the secondary transfer nip portion 37, the secondary transfer voltage causes the toner image on the intermediate transfer belt 3 (having been primarily transferred to the intermediate transfer belt 3) to be secondarily transferred to the recording sheet 36. In this regard, the primary transfer rollers 19, the intermediate transfer belt 3, and the secondary transfer nip portion 37 constitute a transfer section.

The printer 1 includes a fixing unit 6 disposed downstream of the secondary transfer nip portion 37 in a sheet feeding direction along the feeding path 10. The fixing unit 6 (i.e., a fuser or a fixing section) includes a heating roller 41 having an internal heat source, a pressure roller 42 and the like. The heating roller 41 is driven to rotate by a heater motor (not shown). The pressure roller 42 is disposed so as to face the heating roller 41 via the feeding path 10. The pressure roller is pressed against the heating roller 41, and rotates following a rotation of the heating roller 41.

The fixing unit 6 heats (i.e., melts) the toner on the recording sheet 36 inserted into between the heating roller 41 and the pressure roller 42 along the feeding path 10, and fixes the toner image to the recording sheet 36. The printer 1 includes a pair of ejection rollers 34 disposed downstream of the fixing unit 6 in the sheet feeding direction along the feeding path 10. The ejection rollers 34 eject the printed recording sheet 36 (having been fed along the feeding path 10) to a stacker 28 provided on an upper part of the housing 4. Moreover, the printer 1 includes a cleaning blade 43 disposed downstream of the secondary transfer nip portion 37 in the moving direction of the intermediate transfer belt 3 (i.e., the direction shown by the arrow A). The cleaning blade 43 removes a secondary transfer residual toner remaining on the intermediate transfer belt 3 (i.e., a toner having not been secondarily transferred to the recording sheet 36).

The cleaning blade 43 is disposed so as to face the driving roller 21 via the intermediate transfer belt 3. The cleaning blade 43 is formed of flexible rubber material or plastic material. The cleaning blade 43 scrapes off the secondary transfer residual toner remaining on the intermediate transfer belt 3. A waste toner tank 44 receives the toner scraped off by the cleaning blade 43. The printer 1 further includes a display screen 25 configured to display a state of the printer 1.

Figure 2:
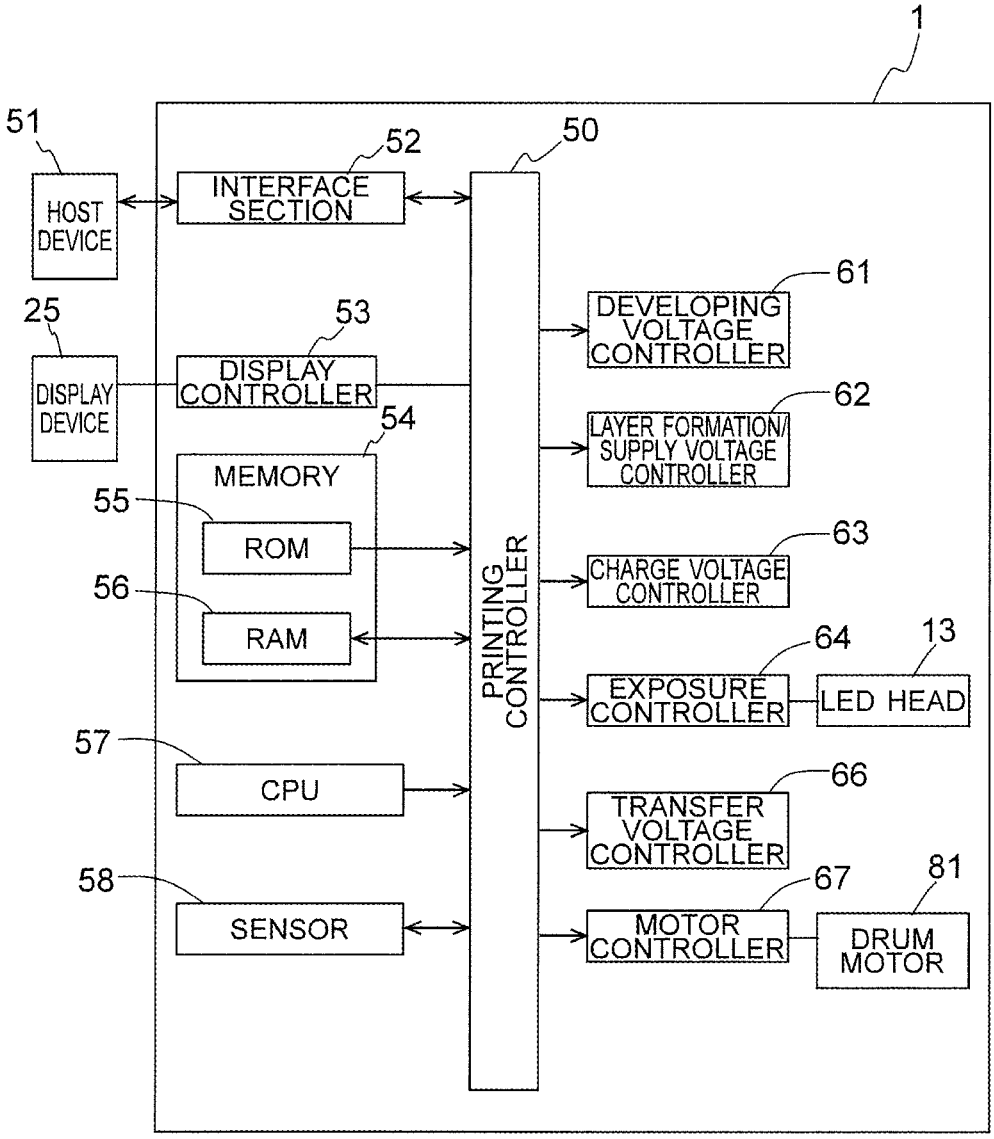
FIG. 2 is a block diagram showing a configuration of a control system to the printer.

FIG. 2 is a block diagram showing a configuration of a control system of the printer 1. As shown in FIG. 2, a printing controller 50 controls the printer 1. The printing controller 50 is connected to an interface section 52, a display controller 53, a memory 54, various sensors 58 and a CPU 57. The interface section 52 receives printing data from a host device 51 as an information input section. The display controller 53 controls a display state of the display screen 25. The memory 54 includes a ROM 55 and a RAM 56. The ROM 55 stores programs for a printing operation and formulae for various corrections. The sensors 58 detect a position of the recording sheet 36, a temperature, a humidity and the like.

Further, the printing controller 50 is connected to a developing voltage controller 61, a layer formation and supply voltage controller 62, a charge voltage controller 63, and an exposure controller 64. The developing voltage controller 61 controls voltages (i.e., developing voltages) applied to the developing rollers 14 of the respective image forming units 2 shown in FIG. 1. The layer formation and supply voltage controller 62 control voltages (i.e., layer formation voltages) applied to the developing blades 15 and controls voltages (i.e., supply voltages) applied to the supply rollers 16. The charge voltage controller 63 controls voltages (i.e., charge voltages) applied to the charging rollers 12. The transfer voltage controller 66 controls voltages (i.e., primary transfer voltages) applied to the primary transfer rollers 19 and controls voltages (i.e., a secondary transfer voltage) applied to the secondary transfer roller 24. An exposure controller 64 controls the LED heads 13 (i.e., writing units) so as to start and stop forming electrostatic latent images at predetermined timings.

A motor controller 67 includes a photosensitive drum motor controller (not shown) that controls photosensitive drum motors (i.e., image bearing body driving sources). The motor controller 67 controls the photosensitive drum motors 81 for the photosensitive drums 11 via the photosensitive drum motor controller, and causes the photosensitive drums 11 (i.e., image bearing bodies) to rotate as shown by arrows in FIG. 1.

Further, each photosensitive drum 11 is provided with a gear (not shown) disposed at an end of its shaft. Each developing roller 14 is provided with a gear (not shown) disposed at an end of its shaft. Each supply roller 16 is provided with a gear (not shown) disposed at an end of its shaft. The gears of the developing roller 14 and the supply roller 16 mesh with the gear of the photosensitive drum 11, and the developing roller 14 and the supply roller 16 are driven to rotate by a rotation of the photosensitive drum 11. Further, the motor controller 67 controls a transfer belt driving motor (not shown) to rotate the driving roller 21 for the intermediate transfer belt 3, and also controls a feed motor (not shown) to rotate the delivery roller 32.

A printing operation of the printer 1 will be described below. The printing controller 50 instructs the motor controller 67 to drive the photosensitive drum motors 81 to thereby rotate the photosensitive drums 11 in the directions shown by the arrows in FIG. 1. When the photosensitive drums 11 rotate, the developing rollers 14 and the supply rollers 16 are driven to rotate via not shown gears. The printing controller 50 instructs the developing voltage controller 61 to apply the predetermined voltages to the developing rollers 14, instructs the supply voltage controller 62 to apply the predetermined voltages to the supply rollers 16 and the developing blades 15, and instructs the charge voltage controller 63 to apply the predetermined voltages to the charging rollers 12. When the photosensitive drums 11 rotate, the charging rollers 12 rotate following the rotations of the photosensitive drums 11, and charge the surfaces of the photosensitive drums 11 to predetermined voltage levels.

When the surfaces of the photosensitive drums 11 are charged, the printing controller 50 instructs the exposure controller 64 to cause the LED heads 13 to emit light to thereby form electrostatic latent images on the charged surfaces of the photosensitive drums 11 based on image data.

The electrostatic latent images are formed on the surfaces of the photosensitive drums 11. The toners held on the supply rollers 16 are supplied to the surfaces of the developing rollers 14. The toners on the developing rollers 14 pass the developing blades 15, are applied with shear stress, and are formed into toner layers having uniform thicknesses. The surfaces of the developing rollers 14 with the toner layers having uniform thicknesses contact the surfaces of the photosensitive drums 11, and the electrostatic latent images on the photosensitive drums 11 are developed with toners.

The printing controller 50 instructs the motor controller 67 to drive the transfer belt driving motor (not shown) to cause the driving roller 21 to rotate in a direction shown by an arrow in FIG. 1. The rotation of the driving roller 21 causes the intermediate transfer belt 3 to move (rotate) in the direction shown by the arrow A. In synchronization with the movement of the intermediate transfer belt 3, the printing controller 50 instructs the motor controller 67 to drive the feed motor (not shown) to rotate the delivery roller 32. The delivery roller 32 rotates in a direction shown by an arrow in FIG. 1 to feed the recording sheet 36 into the feeding path 10. The recording sheet 36 fed into the feeding path 10 by the delivery roller 32 is fed by the feeding rollers 33 toward the secondary transfer nip portion 37.

The printing controller 50 instructs the transfer voltage controller 66 to apply the primary transfer voltages to the primary transfer rollers 19 so as to primarily transfer the toner images from photosensitive drums 11 to the intermediate transfer belt 3 moving in the direction shown by the arrow A. The printing controller 50 instructs the transfer voltage controller 66 to apply the secondary transfer voltage to the secondary transfer roller 24 so as to secondarily transfer the toner image (having been primarily transferred to the intermediate transfer belt 3) from the intermediate transfer belt 3 to the recording sheet 36.

The recording sheet 36 to which the toner image is transferred is fed to the fixing unit 6, and is nipped between the heating roller 41 heated to a predetermined temperature and the pressure roller 42 pressed against the heating roller 41. The toner image is fixed to the recording sheet 36 by application of heat and pressure. The recording sheet 36 with the fixed toner image is ejected via an ejection opening by the ejection rollers 34, and is placed on the stacker 28. Then, the printing operation ends.

Next, the toner as a developer of the embodiment will be described.

The toner of the embodiment is a non-magnetic single-component toner (i.e., a non-magnetic single-component developer). The toner of the embodiment includes colored resin particles. The colored resin particle is obtained by mixing a styrene acrylic copolymer resin formed by an emulsion polymerization method, a colorant (i.e., a coloring agent) and a wax, and causing coagulation. The colored resin particle is mixed with silica particles and nitrogen-containing resin particles using a mixer.

The emulsion polymerization method is as follows. First, a polymer primary particle (i.e., a binder resin of the toner) is formed in a water solvent. A colorant emulsified using an emulsifier (surfactant) is mixed in the solvent. Further, a wax, a charge control agent or the like is mixed in the solvent as necessary. The resulting material is coagulated, and colored resin particles are formed. The colored resin particles are taken out from the solvent, washed and dried so as to remove unnecessary components and byproduct components. In this way, the colored resin particles are obtained.

In a particular example, the styrene acrylic copolymer resin is formed of styrene, acrylic acid and methyl methacrylic acid. Pigment blue 15:3 is used as the colorant. Paraffin wax is used as the wax.

An external additive is added to the colored resin particles. The external additive includes a plurality of kinds of external additives each of which has a mean particle diameter smaller than 200 [nm]. The external additive includes, for example, a hydrophobic silica fine powder (referred to as a small silica) having a mean particle diameter of 8-20 [nm], a hydrophobic silica fine powder (referred to as a large silica) having a mean particle diameter of 20-80 [nm], a colloidal silica fine powder (referred to as a colloidal silica) having a mean particle diameter of 80-140 [nm], and nitrogen-containing resin particles formed of a resin containing nitrogen. The external additive and the colored resin particles are mixed using a HENSCHEL-MIXER® mixing machine (manufactured by Mitsui Mining Co., Ltd.). The mixture is put through sieves, and the toner is obtained.

As the small silica, for example, AEROSIL R972 or AEROSIL R974 manufactured by Nippon Aerosil Co., Ltd. or the like may be used. As the large silica, for example, AEROSIL RX50 or AEROSIL VP RX 40S manufactured by Nippon Aerosil Co., Ltd. or the like may be used. As the colloidal silica, for example, sol gel silica spherical particles X-24-9163A or X-24-9600A-80 manufactured by Shin-Etsu Chemical Co., Ltd. or the like may be used. As the nitrogen-containing resin particles, for example, EPOSTAR SS manufactured by Nippon Shokubai Co., Ltd. may be used.

The toner as a developer of the embodiment has an electric charge amount (i.e., a toner charge amount) in a range from 75.4 to 84.5 [μC/g], as measured according to a "standardized measurement procedure for toner charge" defined by Imaging Society of Japan. In this regard, when the toner charge amount is smaller than 75.4 [μC/g], an amount of reversely charged toner increases, and a printing failure called "fog" may occur. When the toner charge amount is larger than 84.5 [μC/g], a printing failure called "stain" occurs due to an excessively large toner charge amount. The nitrogen-containing resin particles are effective in restricting the toner charge amount within a suitable value.

A plurality of toners having different characteristics are prepared as test samples, and a continuous printing durability test is performed for determining a continuous printing durability of each toner. Hereinafter, the test samples and the continuous printing durability test will be described.

TABLE 1 shows components and cohesion degree of each of the test samples, i.e., toners A through D of Examples 1 through 4 and toners E through J of Comparison Examples 1 through 6. A measuring method of the cohesion degree will be described later.

TABLE 1

| | | SILICA | | NITROGEN-CONTAINING RESIN PARTICLES | | |
|---|---|---|---|---|---|---|
| | | COLLOIDAL | LARGE | | | |
| | TONER | SILICA [wt %] | SILICA [wt %] | EPOSTAR SS | EPOSTAR S | COHESION DEGREE |
| EXAMPLE 1 | A | 2 | 0 | STANDARD AMOUNT | NONE | 67.3 |
| EXAMPLE 2 | B | 2 | 0 | STANDARD AMOUNT × 1.5 | NONE | 80.7 |
| EXAMPLE 3 | C | 1.8 | 0.2 | STANDARD AMOUNT | NONE | 77.1 |
| EXAMPLE 4 | D | 1.6 | 0.4 | STANDARD AMOUNT | NONE | 80.9 |
| COMPARISON EXAMPLE 1 | E | 2 | 0 | STANDARD AMOUNT × 0.5 | NONE | 60.4 |
| COMPARISON EXAMPLE 2 | F | 2 | 0 | NONE | STANDARD AMOUNT | 75.7 |
| COMPARISON EXAMPLE 3 | G | 1.6 | 0 | NONE | STANDARD AMOUNT | 80.8 |
| COMPARISON EXAMPLE 4 | H | 2 | 0.2 | NONE | STANDARD AMOUNT | 92.0 |
| COMPARISON EXAMPLE 5 | I | 0.8 | 0.8 | NONE | STANDARD AMOUNT | 94.1 |
| COMPARISON EXAMPLE 6 | J | 2 | 0 | NONE | NONE | 37.3 |

The toners A through D of Examples 1 through 4 correspond to toners that provide favorable results in the test described later. The toners E through J correspond to toners that provide unfavorable results in the test described later.

As shown in TABLE 1, the toner A of Example 1 is obtained by adding 2 parts by weight of colloidal silica and a standard amount of EPOSTAR SS (manufactured by Nippon Shokubai Co., Ltd.) having a mean particle diameter of 100 [nm] (i.e., small nitrogen-containing resin particles) to 100 parts by weight of the colored resin particles. The toner A of Example 1 does not contain the large silica. The cohesion degree of the toner A is 67.3.

The toner B of Example 2 is obtained in the same manner as the toner A of Example 1 except that the amount of the EPOSTAR SS is changed to 1.5 times the standard amount. The cohesion degree of the toner B is 80.7.

The toner C of Example 3 is obtained in the same manner as the toner A of Example 1 except that the amount of the colloidal silica is changed to 1.8 parts by weight and the amount of the large silica is changed to 0.2 parts by weight. The cohesion degree of the toner C is 77.1.

The toner D of Example 4 is obtained in the same manner as the toner A of Example 1 except that the amount of the colloidal silica is changed to 1.6 parts by weight and the amount of the large silica is changed to 0.4 parts by weight. The cohesion degree of the toner D is 80.9.

In this regard, the diameter of the external additive is in a range smaller than 200 [nm]. Preferably, the diameter of the external additive is in a range from 60 [nm] to 185 [nm]. When the diameter of the external additive is less than 60 [nm], the toner charge amount may be insufficient. When the diameter of the external additive is greater than 185 [nm], the external additive is more likely to separate from the toner.

The toner E of Comparison Example 1 is obtained in the same manner as the toner A of Example 1 except that the amount of EPOSTAR SS is changed to 0.5 times the standard amount. The cohesion degree of the toner E is 60.4.

The toner F of Comparison Example 2 is obtained in the same manner as the toner A of Example 1 except that a standard amount of the EPOSTAR S (manufactured by Nippon Shokubai Co., Ltd.) having a mean particle diameter of 200 [nm] (i.e., large nitrogen-containing resin particles) is added instead of EPOSTAR SS. The cohesion degree of the toner F is 75.7.

The toner G of Comparison Example 3 is obtained in the same manner as the toner F of Comparison Example 2 except that the amount of the colloidal silica is changed to 1.6 parts by weight. The cohesion degree of the toner G is 80.8.

The toner H of Comparison Example 4 is obtained in the same manner as the toner F of Comparison Example 2 except that the amount of the large silica is changed to 0.2 parts by weight. The cohesion degree of the toner H is 92.0.

The toner I of Comparison Example 5 is obtained in the same manner as the toner F of Comparison Example 2 except that the amount of the colloidal silica is changed to 0.8 parts by weight. The cohesion degree of the toner I is 94.1.

The toner J of Comparison Example 6 is obtained in the same manner as the toners A, B, F and G except that the nitrogen-containing resin particles are not contained (i.e., neither the EPOSTAR S nor the EPOSTAR SS is contained). The cohesion degree of the toner J is 37.4.

Here, a measuring method of the cohesion degree (as a parameter relating to a flowability of the toner) will be described.

The cohesion degree is measured using a measuring apparatus "multi-tester MT-1001" (manufactured by Seishin Enterprise Co., Ltd.). In the measuring apparatus "multi-tester MT-1001", three sieves having openings of 250 [μm], 150 [μm] and 75 [μm] are disposed (stacked) in this order from above. 2.00±0.01 [g] of the toner which is to be measured is placed on the uppermost sieve, and then three sieves are vibrated at an amplitude of 1.0 [mm] for 95 [sec].

After the vibration, a weight of the toner remaining on the uppermost sieve having the openings of 250 [μm] is measured. This weight is expressed as "a" [g]. Further, a weight of the toner remaining on the middle sieve having the openings of 150 [μm] is measured. This weight is expressed as "b" [g]. A weight of the toner remaining on the lowermost sieve having the openings of 70 [μm] is measured. This weight is expressed as "c" [g]. Furthermore, a weight of the toner placed on the uppermost sieve before vibration is expressed as "d" [g].

The cohesion degree η is expressed as follows:

$$\eta=(5\times a+3\times b+c)\times 20\div d.$$

In this regard, as the cohesion degree η is lower, the flowability of the toner is higher.

TABLE 2 shows a result of detection (analysis) of the nitrogen-containing resin particle on a toner surface (i.e., a surface of the colored resin particle), and a determination result of whether the external additive larger than 200 [nm] is present on the toner surface.

TABLE 2

| | TONER | NITROGEN-CONTAINING RESIN PARTICLES | | DETECTION OF NITROGEN-CONTAINING RESIN PARTICLE | PRESENCE OF LARGE EXTERNAL ADDITIVE (>200 nm) |
|---|---|---|---|---|---|
| | | EPOSTAR SS | EPOSTAR S | | |
| EXAMPLE 1 | A | STANDARD AMOUNT | NONE | DETECTED | NOT PRESENT |
| COMPARISON EXAMPLE 2 | F | NONE | STANDARD AMOUNT | DETECTED | PRESENT |
| COMPARISON EXAMPLE 6 | J | NONE | NONE | NOT ETECTED | NOT PRESENT |

In a column of the "detection of nitrogen-containing resin particle" of TABLE 2, "detected" indicates that the nitrogen-containing resin particle is detected, "not detected" indicates that the nitrogen-containing resin particle is not detected. In a column of the "presence of large external additive" of TABLE 2, "not present" indicates that the external additive larger than 200 [nm] is considered not to be present on the toner surface, "present" indicates that the external additive larger than 200 [nm] is considered to be present on the toner surface.

Regarding the toner A of Example 1, the nitrogen-containing resin particle is detected, and the external additive larger than 200 [nm] is not present on the toner surface.

Regarding the toner F of Comparison Example 2, the nitrogen-containing resin particle is detected, and the external additive larger than 200 [nm] is present on the toner surface.

Regarding the toner J of Comparison Example 6, the nitrogen-containing resin particle is not detected, and the large external additive (larger than 200 [nm]) is not present on the toner surface.

Regarding the toners B, C, D and E, the same results as the toner A of Example 1 are obtained. This is because the toners B, C, D and E contain only the EPOSTAR SS as the nitrogen-containing resin particles as is the case with the toner A. Regarding the toners G, H and I, the same results as the toner F of Comparison Example 2 are obtained. This is because the toners B, C, D and E contain only the EPOSTAR S as the nitrogen-containing resin particle as is the case with the toner F. For this reason, the results of the toners B, C, D, E, G, H and I are omitted in TABLE 2.

Here, a method of the detection (analysis) of the nitrogen-containing resin particle and a method of determination of the presence of the external additive greater than 200 [nm] will be described.

In order to detect the nitrogen-containing resin particle on the toner surface, an energy dispersion type X-ray spectroscope (EDS) "JSM-7500FA" (manufactured by JEOL Co., Ltd.) is used. Using the energy dispersion type X-ray spectroscope "JSM-7500FA", elemental analysis of the surface of the colored resin particle is performed by means of point analysis at a magnification of 500,000.

Specifically, a peak appearing in a range from 0.38 to 0.42 [keV] is expressed as an N-peak (i.e., a nitrogen peak). A peak appearing in a range from 0.48 to 0.52 [keV] is expressed as an O-peak (i.e., an oxygen peak). A maximum count number in the N-peak of the external additive on the surface of the colored resin particle is expressed as N1. A maximum count number in the O-peak of the external additive on the surface of the colored resin particle is expressed as O1. A maximum count number in the N-peak of the surface of the colored resin particle where no external additive is observed is expressed as N2. A maximum count number in the O-peak of the surface of the colored resin particle where no external additive is observed is expressed as O2. When the count numbers N1, O1 and N1 and O2 satisfy the following formula (1), the external additive is determined to be the nitrogen-containing resin particle (i.e., the external additive contains a large amount of nitrogen):

$$1.7\times(N2/O2)<(N1/O1) \quad (1)$$

This determination is not based on the maximum count number in the N-peak only, but based on comparison of the maximum count number in the N-peak and the maximum count number in the O-peak. This is in order to eliminate an influence of a difference in observation conditions and compositions of the colored resin particles on the maximum count number in the N-peak.

50 external additives having a size larger than 50 [nm] observed on the surface of one colored resin particle are analyzed using the above described method (i.e., elemental analysis). When at least one nitrogen-containing resin particle is detected among the 50 external additives, it is determined that the nitrogen-containing resin particle is present on the toner surface. When no nitrogen-containing resin particle is detected among the 50 external additives, it is determined that the nitrogen-containing resin particle is not present on the toner surface.

Here, an example of determination whether the external additive is a nitrogen-containing resin particle or not will be described. TABLE 3 shows the results of elemental analysis of the external additives A and B observed on the surface of the colored resin particle of the toner A of Example 1. In TABLE 3, a peak appearing in a range from 0.26 to 0.30 [keV] is defined as a C (carbon) peak. A peak appearing in a range from 1.70 to 1.74 [keV] is defined as a Si (silicon) peak.

TABLE 3

| | COUNT NUMBER (×1000) | | | | | | RESULT OF EVALUATION OF NITROGEN-CONTAINING RESIN PARTICLES |
|---|---|---|---|---|---|---|---|
| | C PEAK | N PEAK | O PEAK | Si PEAK | N1/O1 | N2/O2 | |
| SURFACE OF COLORED RESIN PARTICLE | 18 | 0.2 (N2) | 0.7 (O2) | 0.3 | — | 29% | — |
| EXTERNAL ADDITIVE A | 12 | 0.2 (N1) | 0.9 (O1) | 0.9 | 22% | — | NO |
| EXTERNAL ADDITIVE B | 17 | 0.4 (N1) | 0.6 (O1) | 0.4 | 67% | — | YES |

In the elemental analysis of the external additive of the toner A, an external additive (referred to as an external additive A) having a large count number in the Si peak and an external additive (referred to as an external additive B) having a large count number in the N peak are observed. From the results shown in TABLE 3 and the above described formula (1), it is determined that the external additive A is not a nitrogen-containing resin particle, but a silica particle. In contrast, it is determined that the external additive B is a nitrogen-containing resin particle, since the external additive B has a large count numbers in the N peak.

Next, determination of the presence of the external additive larger than 200 [nm] on the toner surface will be described. A field emission scanning electron microscope (FE-SEM) is used to determine whether the external additive larger than 200 [nm] is included in the external additives adhering to the surface of the colored resin particle. To be more specific, the above described spectroscope "JSM-7500FA" manufactured by JOEL Co., Ltd. is used, and 10 toner particles are observed at an observation magnification of 10,000. When no external additive larger than 200 [nm] is observed on the 10 toner particles, it is determined that the external additive larger than 200 [nm] is not present on the toner surface. When at least one external additive larger than 200 [nm] is observed on at least one of 10 toner particles, it is determined that the external additive larger than 200 [nm] is present on the toner surface.

Description will be made of a continuous printing durability test for determining continuous printing durability of the toners A through D of Examples 1 through 4 and the toners E through J of Comparison Examples 1 through 6. In the continuous printing durability test, test samples of the toners A through J are used. Here, the toners containing colorant of cyan (i.e., pigment blue 15:3) are used as test samples.

The continuous printing durability test is performed using the above described printer 1 (FIG. 1), and filling the toner (i.e., the test sample) in the cyan image forming unit 2C. During printing, voltages applied to the respective parts of the printer 1 are controlled so that an amount of the toner adhering to the surface of the developing roller 14C is in a range from 0.4 to 0.6 [mg/cm$^2$] and an amount of the toner adhering to the photosensitive drum 11C is in a range from 0.4 to 0.5 [mg/cm$^2$].

Figure 3:
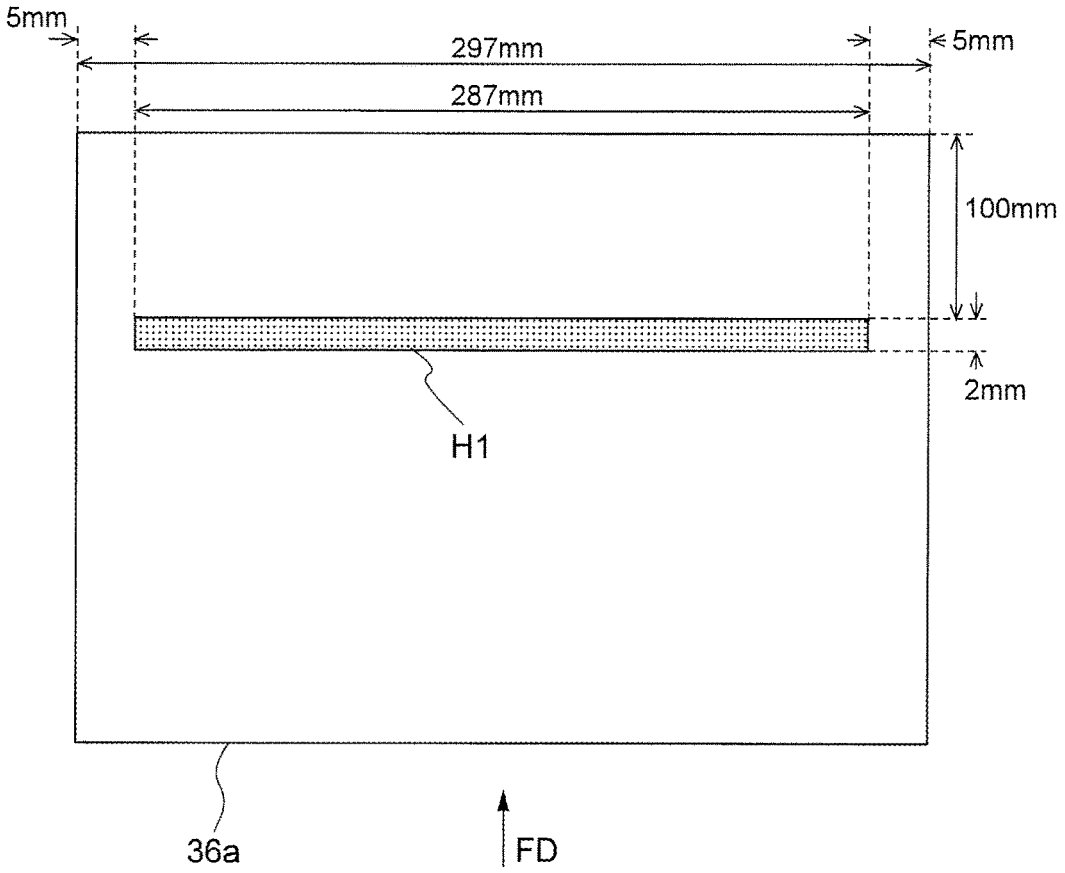
FIG. 3 is a schematic view showing a printing image to be continuously printed in a continuous printing durability test.

The continuous printing durability test is performed in the following steps:

1. The printer 1 is placed in an environment at a temperature of 22 [° C.] and a humidity of 40 [%] for 12 hours or more.
2. Evaluations of image blurring, a vertical streak and ghost described later are performed (i.e., evaluations at an initial stage).
3. Continuous printing is performed on 8000 recording sheets. In the continuous printing, a horizontal streak image shown in FIG. 3 and having a cyan density of 100% is printed on the recording sheet (indicated by mark 36*a* in FIG. 3) at a printing area ratio of 1%. As the recording sheet 36*a*, "Excellent White Paper" (70 kg paper) of A4 size (297 mm×210 mm) manufactured by Oki Data Corporation is used. The recording sheet 36*a* is fed in a long-edge-feed manner. The printer 1 has a printing speed of 45 ppm (page per minutes), and performs printing on one recording sheet 36*a* every 30 seconds. As shown in FIG. 3, the horizontal streak image (shown by mark H1) is printed at a position of 10 mm from a leading edge of the recording sheet 36*a* in the sheet feeding direction (shown by an arrow FD). The horizontal image H1 has a width of 2 mm in the sheet feeding direction, and a length of 287 mm in a widthwise direction of the recording sheet 36*a*.
4. Evaluations of image blurring, a vertical streak and ghost described later are performed (i.e., evaluations after continuous printing).

Figure 4:
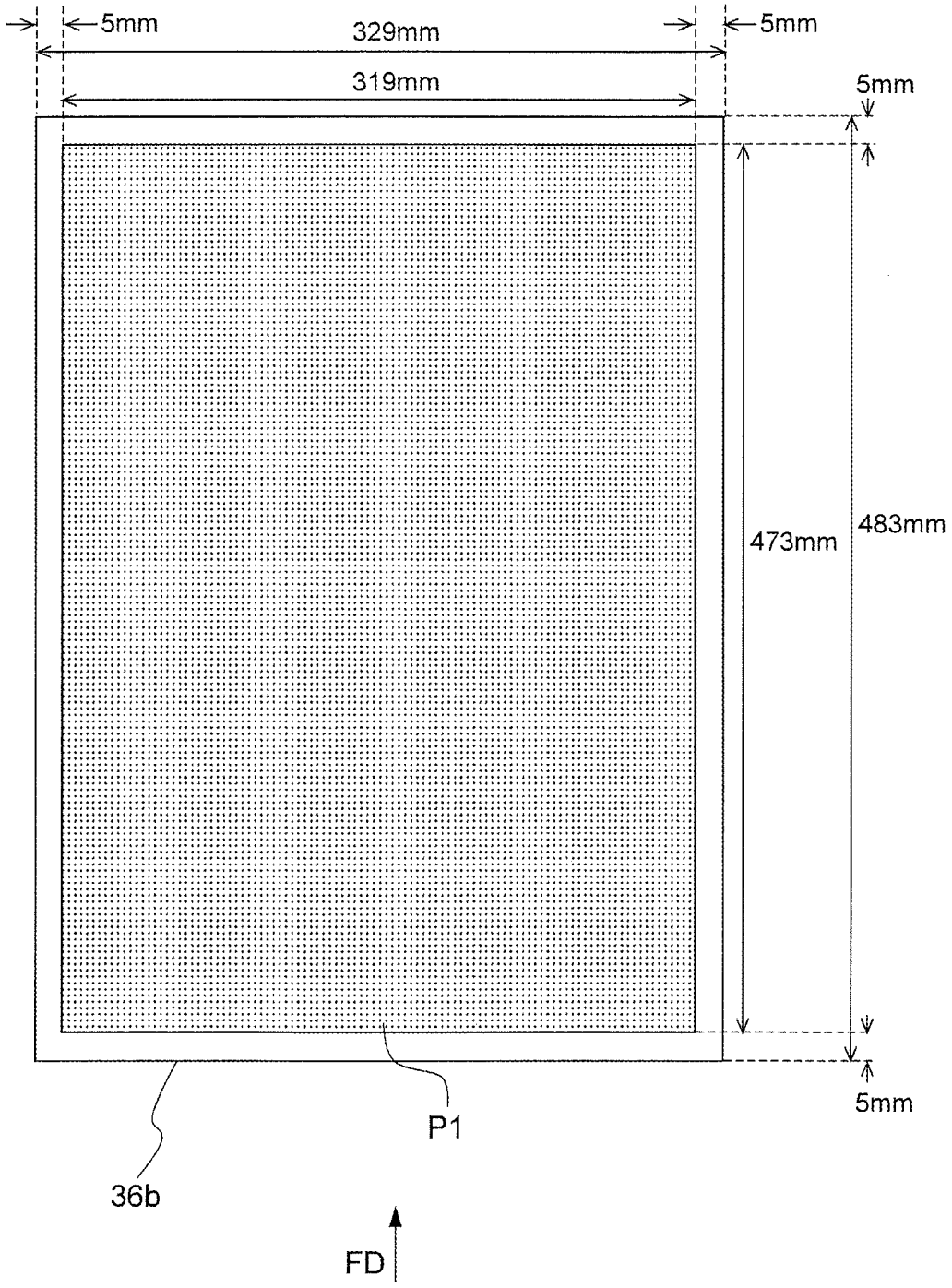
FIG. 4 is a schematic view showing a printing image having a cyan density of 100% used in evaluation of image blurring and evaluation of a vertical streak.

A method for evaluation of image blurring will be described. In the evaluation of image blurring, a printing image P1 having a cyan density of 100% as shown in FIG. 4 is printed on a recording sheet (indicated by mark 36*b* in FIG. 4) at a printing speed of 45 ppm. As the recording sheet 36*b*, "Excellent White Paper" (70 kg paper) of A3-Nobi size (483 mm×329 mm) is used.

Figure 5:
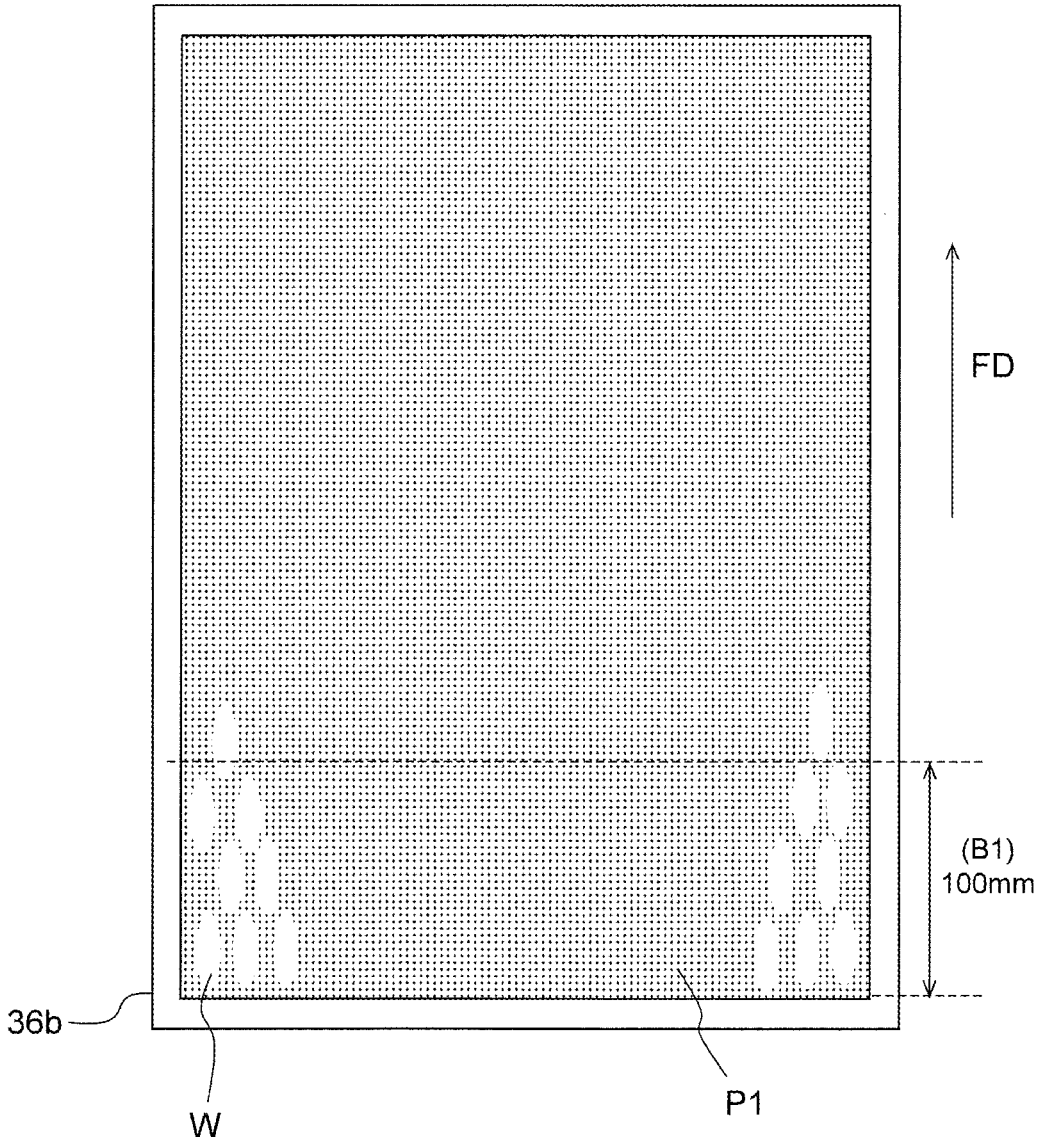
FIG. 5 is a schematic view showing an example of white voids observed in the evaluation of the image blurring.

Then, it is checked whether a white void (indicated by mark W in FIG. 5) whose optical density (i.e., OD value) is less than or equal to 1.0 is found in a trailing part of the printing image P1 in the sheet feeding direction FD. Checking is performed on a part having the thinnest density in an area of 100 mm (shown by mark B1 in FIG. 5) from a trailing edge of the printing image P1 using an apparatus "X-Rite 528" (set to Status I) manufactured by X-Rite Corporation. When no void is found, the evaluation result is "O" (i.e., excellent). When a white void is found, the evaluation result is "x" (i.e., poor).

A method for evaluation of a vertical streak will be described. In the evaluation of the vertical streak, a printing image P1 having a cyan density of 100% as shown in FIG. 4 is printed on the recording sheet 36*b* "Excellent White Paper" (A3-Nobi size, 70 kg paper) at a printing speed of 45 ppm. Optical densities (i.e., OD values) are measured at nine positions (indicated by marks M1 through M9 in FIG. 6) within an area of 50 mm from a leading edge of the printing image P1 in the sheet feeding direction FD. It is determined whether a stable density is obtained or not based on the measured optical densities.

Figure 6:
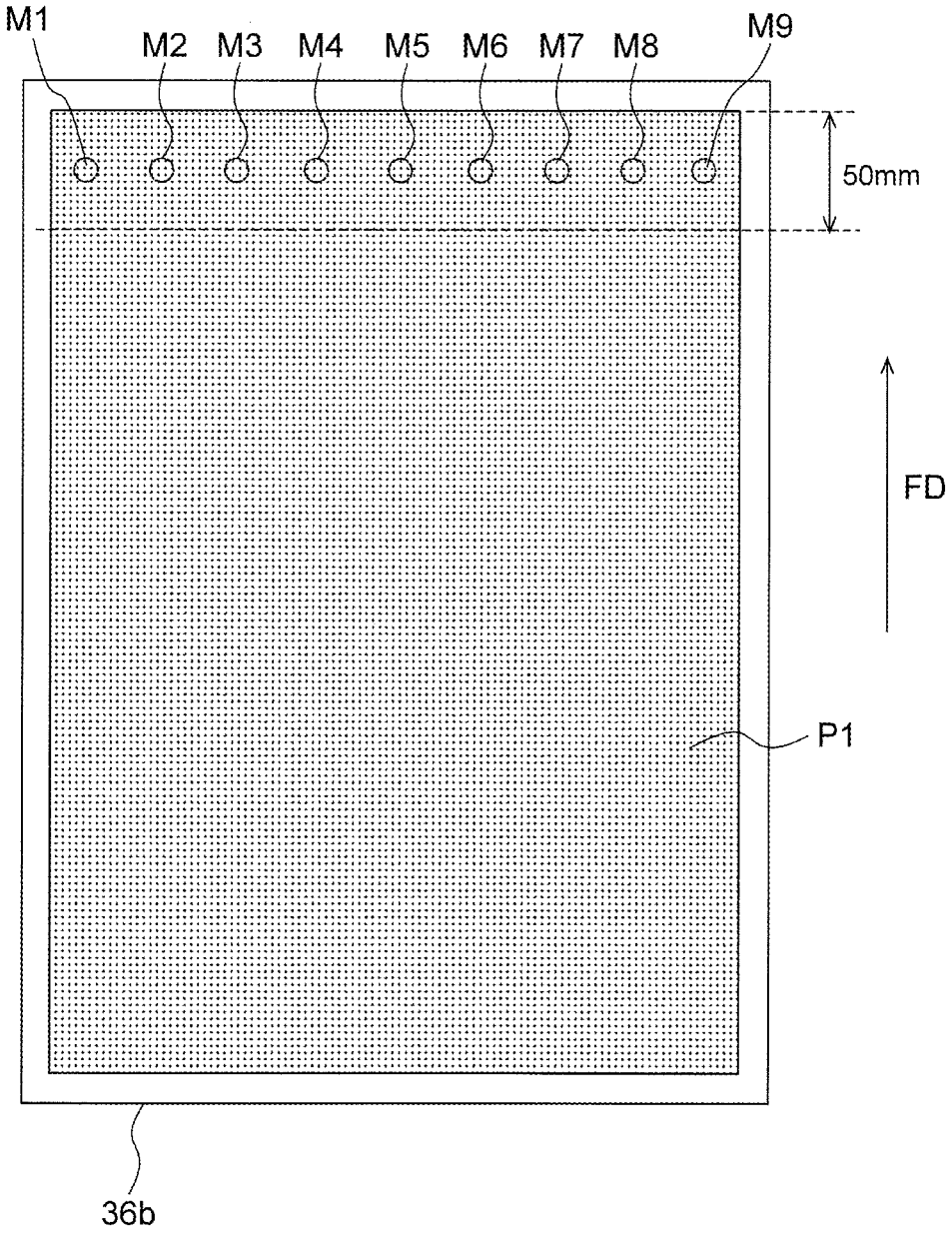
FIG. 6 is a schematic view showing measurement positions where optical densities are measured for the evaluation of the vertical streak.

The nine positions (i.e., density measurement positions) are referred to as measurement points M1, M2, M3, M4, M5, M6, M7, M8 and M9 from the left to the right in FIG. 6. The point M1, M2, M3, M4, M5, M6, M7, M8 and M9 are respectively positioned at 10 mm, 48 mm, 87 mm, 126 mm, 165 mm, 203 mm, 242 mm, 281 mm and 320 mm from a left edge of the recording sheet 36*b*. The optical densities are measured using the apparatus "X-Rite 528" (set to Status I) manufactured by X-Rite Corporation. When all of the optical densities (OD values) at the nine measurement points M1 through M9 are within a range from 1.30 to 1.50, the evaluation result is "O". When at least one of the optical densities (OD values) at the nine measurement points M1 through M9 is out of the range from 1.30 to 1.50, the evaluation result is "x".

Figure 7:
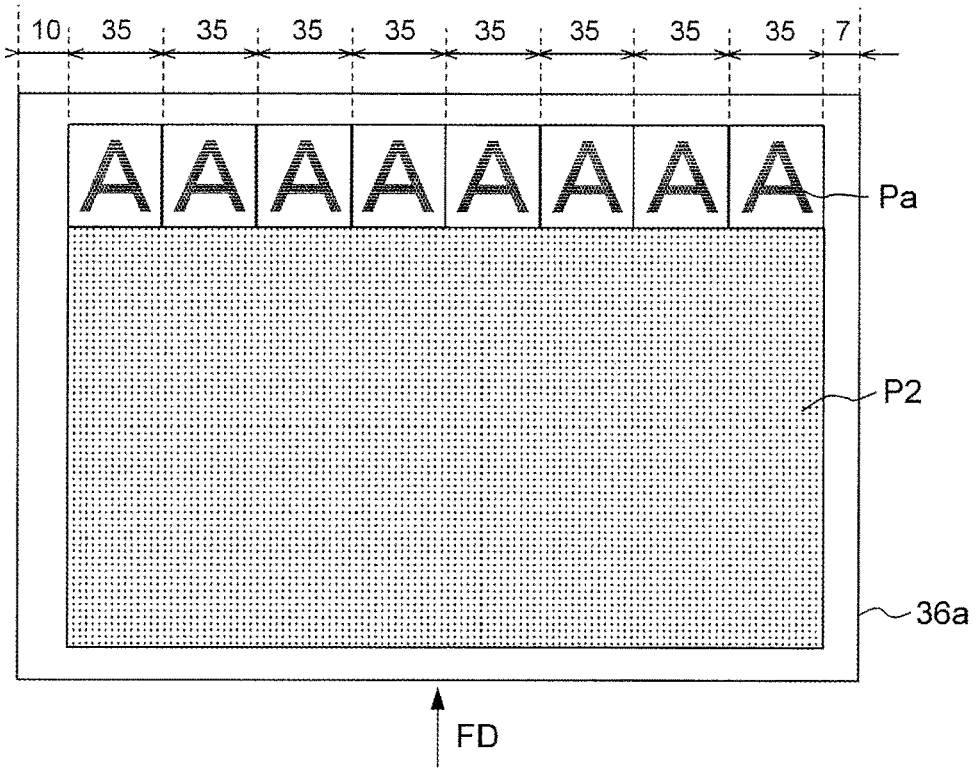
FIG. 7 is a schematic view showing a printing image used in evaluation of ghost.

A method for evaluation of ghost will be described. In the evaluation of ghost, eight ghost-evaluation printing images Pa each having a cyan density of 100% are printed on the recording sheet 36*a*, i.e., "Excellent White Paper" (A4 size, 70 kg paper). The ghost-evaluation printing image Pa is in the form of a letter "A". The recording sheet 36*a* is fed in the long-edge-feed manner, and the ghost-evaluation printing images Pa are printed in a leading part of the recording sheet 36*a* in the sheet feeding direction FD as shown in FIG. 7. The eight ghost-evaluation printing images Pa are arranged at substantially equal intervals (35 mm). An interval of 10 mm is provided between the left edge of the recording sheet 36*a* and a leftmost ghost-evaluation printing image Pa, and an interval of 7 mm is provided between the right edge of the recording sheet 36*a* and the rightmost ghost-evaluation printing image Pa. A solid printing image P2 having a cyan density of 25% (i.e., a 25% density area) is printed on the recording sheet 36*a* following the ghost-evaluation printing images Pa in the sheet feeding direction FD. It is checked whether ghost (indicated by mark R in FIG. 8) of the ghost-evaluation printing images Pa appears in the 25% density area (i.e., the printing image P2) as shown in FIG. 8.

Figure 8:
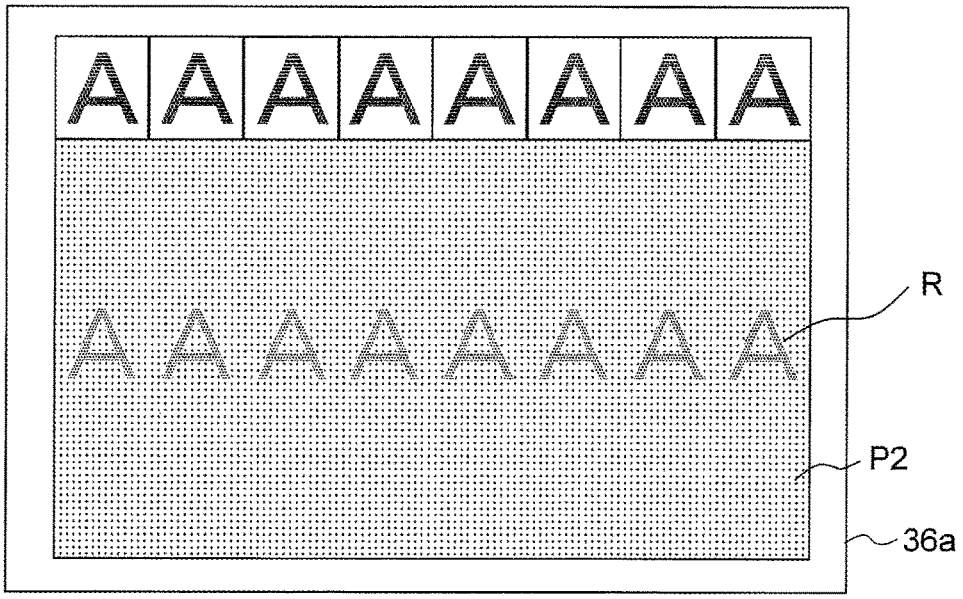
FIG. 8 is a schematic view showing an example of ghost observed in the evaluation of the ghost.

When the external additives separating from the toner adhere to the photosensitive drum 11C (FIG. 1), ghost R in the form of thick letters appears in the 25% density area as shown in FIG. 8. When no ghost in the form of thick letters is visually observed with naked eyes in the 25% density area, the evaluation result is "O". When the ghost in the form of thick letter is visually observed with naked eyes in the 25% density area, the evaluation result is "x".

Evaluation results of the above described continuous printing durability test are shown in TABLE 4.

TABLE 4

| | | | EVALUATION RESULT AT INITIAL STAGE | | | EVALUATION RESULT AFTER CONTINUOUS PRINTING | | |
|---|---|---|---|---|---|---|---|---|
| | TONER | COHESION DEGREE | IMAGE BLURRING | VERTICAL STREAK | GHOST | IMAGE BLURRING | VERTICAL STREAK | GHOST |
| EXAMPLE 1 | A | 67.3 | ○ | ○ | ○ | ○ | ○ | ○ |
| EXAMPLE 2 | B | 80.7 | ○ | ○ | ○ | ○ | ○ | ○ |
| EXAMPLE 3 | C | 77.1 | ○ | ○ | ○ | ○ | ○ | ○ |
| EXAMPLE 4 | D | 80.9 | ○ | ○ | ○ | ○ | ○ | ○ |
| COMPARISON EXAMPLE 1 | E | 60.4 | ○ | X | ○ | ○ | X | ○ |
| COMPARISON EXAMPLE 2 | F | 75.7 | ○ | ○ | X | ○ | ○ | X |
| COMPARISON EXAMPLE 3 | G | 80.8 | ○ | ○ | X | ○ | ○ | X |
| COMPARISON EXAMPLE 4 | H | 92.0 | ○ | ○ | X | ○ | ○ | X |
| COMPARISON EXAMPLE 5 | I | 94.1 | ○ | ○ | ○ | X | ○ | ○ |

From the result shown in TABLE 4, it is understood that the toners A, B, C and D of Examples 1, 2, 3 and 4 exhibit excellent evaluation results of the image blurring, the vertical streak and the ghost in the continuous printing durability test.

Regarding the toner E of Comparison Example 1, the vertical streak occurs. This is considered to be because the toner E has an excessively high flowability, and therefore a thickness of the toner layer on the developing roller 14C becomes uneven.

Regarding the toners F, G and H of Comparison Examples 2, 3 and 4, the ghost is observed. This is considered to be because the toners F, G and H contain the external additives larger than 200 [nm], and therefore the external additives separate from the surfaces of the colored resin particles and adhere to the surface of the photosensitive drum 1 (FIG. 1).

Regarding the toner I of Comparison Example 5, the image blurring occurs. This is considered to be because the toner I has an excessively low flowability, and therefore an amount of the toner supplied from the supply roller 16C to the developing roller 14C is insufficient. In this regard, the toner I exhibits an excellent evaluation result of ghost, which is considered to relate to silica content.

Regarding the toner J of Comparison Example 6, an image having a density required for evaluating the image blurring, the vertical streak and the ghost could not be formed, because the toner J is less likely to adhere to the developing roller due to the insufficient toner charge amount. For this reason, evaluation of the image blurring, the vertical streak and the ghost could not be performed.

From these results, it is understood that the image blurring, the vertical streak and the ghost can be suppressed when the toners A through D of Examples 1 through 4 are used.

As a result of the above described evaluations, it is understood that the image blurring, the vertical streak and the ghost can be suppressed when printing is performed using the toner (i.e., developer) satisfying the following conditions:

(A) a particle diameter of the external additive is smaller than or equal to 200 nm;

(B) the maximum count number N1 in the N-peak and the maximum count number O1 in the O-peak of the external additive on the surface of the colored resin particle, and the maximum count number N2 in the N-peak and the maximum count number O2 in the O-peak of the surface of the colored resin particle where no external additive is observed satisfy 1.7×(N2/O2)<(N1/O1); and (C) the toner has a cohesion degree in a range from 63.7 to 80.9.

In this embodiment, the colored resin particles of the toner are formed by the emulsion polymerization method. However, a method of forming the colored resin particles is not limited. For example, the colored resin particles of the toner may be formed by a pulverization method, a suspension polymerization method, a solution suspension method, or the like.

Further, in this embodiment, the toner (as an example of the developer) contains the cyan pigment. However, a pigment contained in the toner is not limited. For example, the toner may contain a black, yellow or magenta pigment. In other words, the toner may be of a general color.

As described above, the image blurring, the vertical streak, the ghost and the like can be suppressed when the toner (i.e., developer) of the embodiment of the present invention is used.

A color printer has been described as an example of an image forming apparatus in the above described embodiment. However, the present invention is also applicable to a monochrome printer, a copying machine, a facsimile machine, a MFP (Multi-Function Peripheral) or the like.

While the preferred embodiments of the present invention have been illustrated in detail, it should be apparent that modifications and improvements may be made to the invention without departing from the spirit and scope of the invention as described in the following claims.

What is claimed is:

1. A toner comprising:

a colored resin particle; and an external additive added to a surface of the colored resin particle and having particle diameters smaller than or equal to 200 [nm], the external additive comprising nitrogen-containing resin particles, wherein, in elemental analysis of the nitrogen-containing resin particles using an energy dispersion X-ray spectroscope, when a peak appearing in a range from 0.38 to 0.42 keV is expressed as an N-peak, a peak appearing in a range from 0.48 to 0.52 keV is expressed as an O-peak, a maximum count number in the N-peak and a maximum count number in the O-peak of the external additive on a surface of the colored resin particle are respectively expressed as N1 and O1, and a maximum count number in the N-peak and a maximum count number in the O-peak of the surface of the colored resin particle where no external additive is observed are respectively expressed as N2 and O2, the count numbers N1, O1, N2 and O2 satisfy 1.7 x (N2/O2) <(N1/O1), and wherein the toner has a cohesion degree in a range from 63.7 to 80.9.

2. The toner according to claim 1, wherein the external additive comprises silica.

3. The toner according to claim 1, wherein the nitrogen-containing resin particles have particle diameters in a range from 60 [nm] to 185[nm].

4. The toner according to claim 1, wherein the external additive includes a plurality of different external additives, each external additive having a mean particle diameter smaller than 200 [nm].

5. A toner cartridge comprising a storage part storing the toner according to claim 1.

6. A developing device comprising:

a latent image bearing body;

a charging member that charges a surface of the latent image bearing body; and a developer bearing body that bears the toner according to claim 1, and develops a latent image on the surface of the latent image bearing body using the toner.

7. The developing device according to claim 6, further comprising a resilient member contacting the latent image bearing body at a position upstream of the charging member and downstream of the developer bearing body in a rotating direction of the latent image bearing body.

8. An image forming apparatus comprising:

the developing device according to claim 6;

a transfer section that transfers a toner image formed on the surface of the latent image bearing body to a recording medium; and a fixing section that fixes the toner image to the recording medium.

9. The image forming apparatus according to claim 8, wherein the image forming apparatus has a configuration of a non-magnetic single-component development system.

* * * * *